United States Patent [19]

Peck

[11] 4,274,666

[45] Jun. 23, 1981

[54] LOCK FOR SLIDING WINDOWS AND DOORS

[76] Inventor: Almo E. Peck, 56 W. Sunset Ave. Salt Lake City, Utah 84115

[21] Appl. No.: 91,045

[22] Filed: Nov. 5, 1979

[51] Int. Cl.[3] ..... E05C 3/04

[52] U.S. Cl. ..... 292/257; 292/DIG. 47

[58] Field of Search ..... 292/73, 204, 257, DIG. 7, 292/DIG. 46, DIG. 47, DIG. 73, 241, 238, 230, 202

[56] References Cited

U.S. PATENT DOCUMENTS

| | | | |
|---|---|---|---|
| 510,614 | 12/1893 | Robertson | 292/DIG. 7 |
| 847,345 | 3/1907 | Leach | 292/338 X |
| 1,802,639 | 4/1931 | Estey et al. | 292/204 X |
| 3,009,215 | 11/1961 | Fraleigh | 292/DIG. 46 |

*Primary Examiner*—Richard E. Moore
*Attorney, Agent, or Firm*—K. S. Cornaby

[57] ABSTRACT

A pressure-sensitive lock for sliding windows and doors has rotatable eccentric cam means adapted to be mounted on the sash of a sliding window or door so as to engage the adjacent window frame when the cam means is rotated into the locking position. The lock also has a pressure block for mounting on the opposite side of the window adjacent the frame, such that when the cam means is placed in locking position against the frame, the sliding window is forced toward the opposite frame and the pressure block is thereby wedged against the frame to prevent the window from opening.

4 Claims, 4 Drawing Figures

LOCK FOR SLIDING WINDOWS AND DOORS

BACKGROUND OF THE INVENTION

Since the advent of sliding windows and doors, such as glass patio doors, attempts have been made to provide locking means for such windows and doors. While adequate means have long since been available for securely locking windows and doors in the closed position, the numerous devices proposed for locking windows and doors while in the partially open position have never been successful.

It has long been recognized that a need exists for a means for locking sliding doors and windows in a partially open position, so as to prevent intruders from opening the window or door wider to gain access. Resort has been had to poles or sticks of wood to be lodged between the window sash and the frame. Such means have proven partially effective for laterally-sliding windows and doors, but are ineffective for vertically sliding windows.

Several prior art attempts at other types of locks have been patented, such as those disclosed in U.S. Pat. Nos.: 1,100,820; 1,442,657; 1,461,467; 1,311,052; 1,398,174; and 3,428,349. The 1,311,052 and 1,398,174 patents appear to disclose means for wedging a semi-circular-shaped rotatable member against a window frame, but rely on a toothed surface on the member to engage the frame and prevent further rotation of the member.

In practice these prior art devices are not effective. The toothed edge of the rotating member chews into the normally wooden frame of the window and present unsightly appearance. Moreover, over a period of time a channel is gouged into the frame and the member cannot engage the frame. A Major inadequacy of all of the pressure-type locks results from the normal spacing between the edge of the sash and the window frame. When a pressure-type lock of the prior art is engaged with a window frame, the window itself is shifted over to occupy the space between the opposite sash and the frame, thereby preventing a secure engagement of the rotatable member with the frame.

It is therefore an object of this invention to provide a sliding window and door locking means which will enable the window or door to be secured in any open position, and will permit the window or door to be closed, but not opened further from the exterior.

It is also an object of this invention to provide a locking means for both laterally and vertically sliding windows and doors.

It is a further object of this invention to provide a locking means which permits positive engagement of cam means without lateral slippage of the window or overriding of the cam means.

SUMMARY OF THE INVENTION

A pressure-sensitive locking means is provided for vertically and laterally sliding windows and doors, which permits the window or door to be opened to any position and automatically secured in that position, thereby preventing the window from being opened any further from the exterior, but permitting the window to be closed further from the exterior or interior.

The pressure-sensitive lock has a rotatable, eccentric-shaped cam means adapted to be mounted on a window or door sash adjacent to the frame, so that when in the locking position, the cam edge engages the frame. The cam means preferably has a rotatable cam secured on a pivot post to a mounting plate which has means for securing the plate to a window sash.

The rotatable cam has face means which describes generally an arc, but with a significant feature. The radius of the arc increases from the leading edge of the cam face to the trailing edge. The purpose of this feature is to provide continuous pressure on the window frame by the cam regardless of the spacing or "play" between the sash and frame, and to prevent cam override, which would be possible if the cam were entirely arcuate in shape, as is found in the prior art locking devices.

In addition to the cam means, the lock has blocking means, preferably in the form of a pressure block for mounting on the window adjacent to the frame on the opposite side of the window or door from the cam means. The function of the block is to minimize lateral movement of the window within the frame, in the case of vertically sliding windows, and vertical movement within the frame, in the case of laterally sliding windows and doors, when the cam is engaged with the frame to apply pressure against the frame.

THE DRAWINGS

Preferred embodiments of the invention are illustrated in the accompanying drawing, in which:

FIG. 1 is broken front elevational view of the locking means in position on a laterally sliding window;

FIG. 2, a partial front elevational view of the locking means in position on a vertically sliding window;

FIG. 3, a top plan view of a vertically sliding window showing the locking means in position; and FIG. 4, a perspective view of the elements of the locking means in position on a window sash.

DETAILED DESCRIPTION OF THE ILLUSTRATED EMBODIMENT

Figure 1:
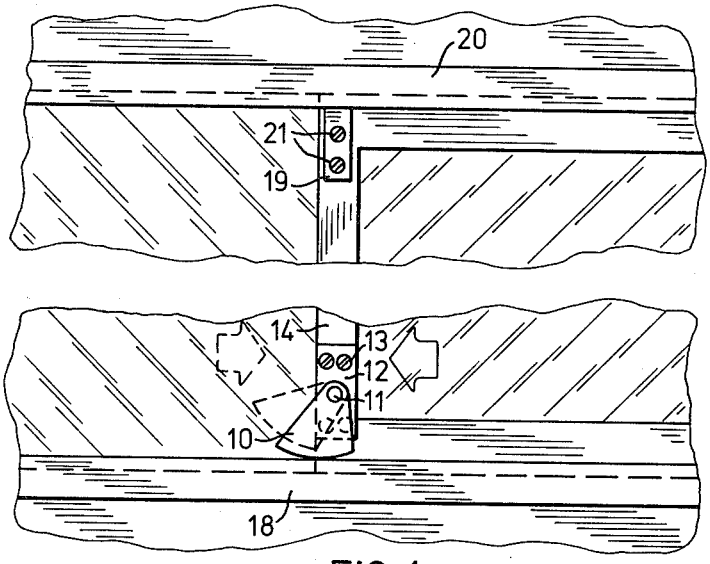

As illustrated in FIGS. 1, 2, 3 and 4, preferred embodiments of the invention can be mounted on laterally (FIG. 1) or vertically (FIGS. 2 and 3) sliding windows and doors. The locking means has in this embodiment an eccentrically-shaped can 10 rotatably mounted on a pivot post 11 which in turn is attached to a mounting plate 12. Mounting plate 12 is adapted to be secured by appropriate means, in this embodiment screws 13, to a window sash 14. In order to facilitate the free rotation of cam 10, a washer 15 can be disposed on pivot post 11, and cam 10 secured to the post by a cotter pin 16.

Figure 4:
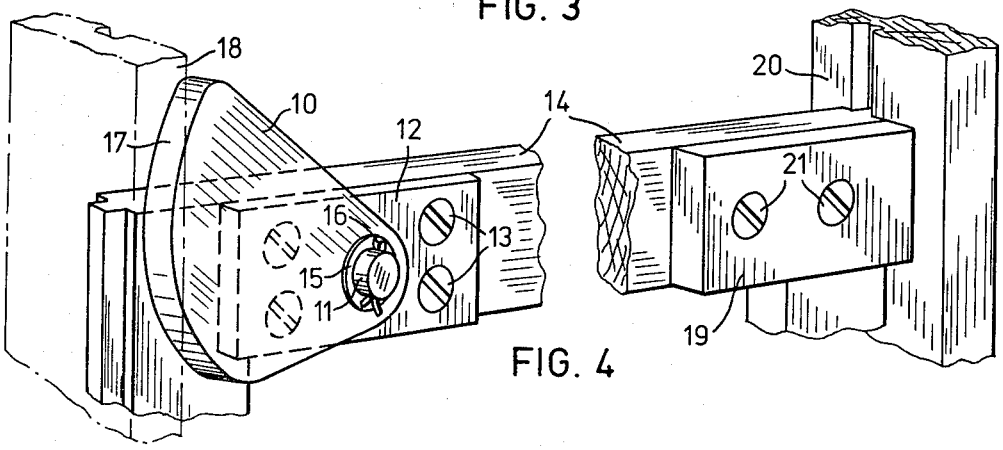

The shape of cam 10 is important to the functioning of the locking means. As illustrated in FIG. 4, while the face 17 of cam 10 has a generally arcuate shape, it does not form a true arc. The lower, or leading edge, of face 17 has a shorter radius, typically of about $1\frac{1}{4}$ inches, from the center of the pivot post. Between the leading edge and the trailing edge of face 17, the radius gradually increases, to $1\frac{1}{2}$ inches, with the center of the face 17 having a radius of about $1\frac{3}{8}$ inches, for example. These dimensions are illustrative of the radial dimension increase which results in a gentle curve to face 17, but not a true arc or a tangent.

The purpose for the unique shape of cam 10 is to provide ever increasing pressure on window frame 18 adjacent to cam 10 when cam 10 is in position against frame 18 as pressure is applied to open the window or door. Cam 10 is mounted on sash 14 in such a position that the longer radius of face 10, i.e., the trailing edge is in the direction of opening the window. As increased pressure is applied to open the window further, face 17 of cam 10 applies increasing pressure on frame 18 by reason of the unique shape of cam 10.

Moreover, the unique shape of cam 10 prevents cam "override", which is found with arcuate shaped locks. This occurs when sufficient pressure is exerted on the window to force the arcuate shaped lock beyond the center of the arc. At that point the arcuate-shaped lock of the prior art simply drops, and the window is left free to open. This is entirely avoided by the present cam 10. Face 17 of cam 10 can have a smooth, but not slick face, and can have a slightly sticking surface.

Figure 2:
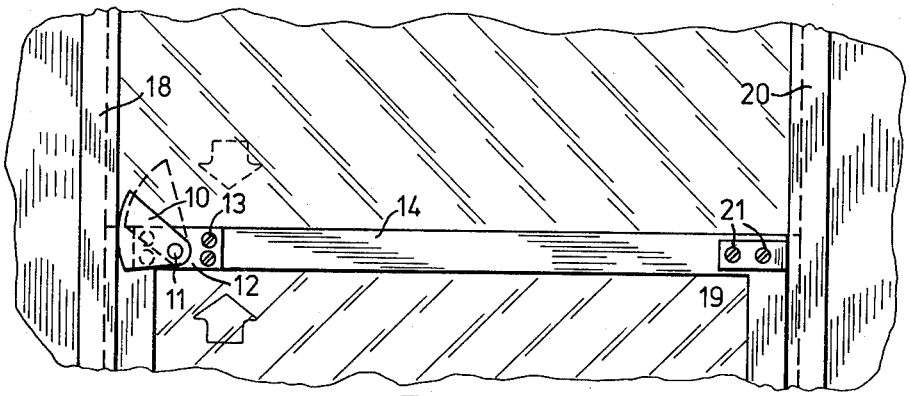
Figure 3:
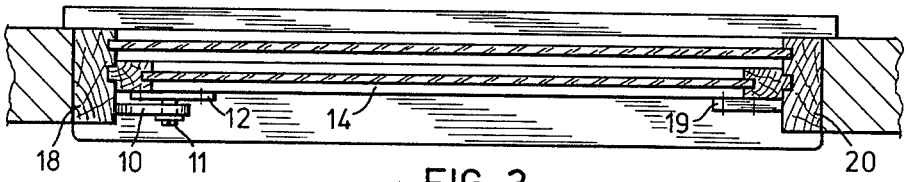

A further feature of this invention is the pressure block 19 mounted on sash 14 on the opposite side of the window adjacent to opposite frame 20 b appropriate means, such as screws 21 shown in FIG. 4. The purpose of block 19 is to prevent the lateral sliding of a window sash within the frame as illustrated in FIGS. 2 and 3, when pressure is applied to cam 10. The attempt to raise the window forces lateral pressure from cam 10 to pivot post 11 and sash 14, thus locking the window in place. In the typical window construction, there is space provided between the outer edges of sash 14 and frames 18 and 20 to facilitate the raising and lowering of the window. This space has make it virtually impossible for prior art pressure-type locking devices to function, since, as soon as pressure is applied, the sash shifts laterally and the lock falls away.

The presence of block 19 prevents such shifting of the sash both in the vertically and in the laterally sliding windows.

It is to be understood that the particular forms of the invention described and illustrated herein are preferred embodiments. Various changes in sizes, materials and arrangement of parts can be made without departing from the scope of the invention as defined in the attached claims.

I claim:

1. Locking means for sliding windows and doors, comprising:

rotatable eccentric cam means for mounting on a window sash adjacent a window frame, said cam means having a generally arc-shaped contact face for engaging the window frame, said face having a leading edge and a trailing edge, with the radius between said face and the pivot point of said cam means gradually increasing from the leading edge to the trailing edge, so as to apply increasing pressure on the frame as the window is attempted to be opened;

mounting means for mounting on the sash, and having means on which said cam means is rotatably mounted at said pivot point; and a pressure block for fixedly mounting on the window sash adjacent the window frame on the opposite side of the window from said cam means, so that when said cam means applies pressure on the frame, the frame transfers the pressure to said mounting block.

2. Locking means as set forth in claim 1, wherein said mounting means comprises a mounting plate for mounting in a window sash, said plate having a pivot post for receiving and rotatably holding said cam means.

3. Locking means as set forth in claim 1, for mounting on a laterally-sliding window respectively at the top and bottom.

4. Locking means as set forth in claim 1, for mounting on a vertically-sliding window respectively at the top and bottom.

* * * * *